US011707118B2

(12) United States Patent
Di Piazza

(10) Patent No.: US 11,707,118 B2
(45) Date of Patent: Jul. 25, 2023

(54) ELASTIC ARTICULATION FOR A WATCH ASSEMBLY

(71) Applicant: ROLEX SA, Geneva (CH)

(72) Inventor: Philippe Di Piazza, Ville-la-Grand (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 16/984,288

(22) Filed: Aug. 4, 2020

(65) Prior Publication Data

US 2021/0045503 A1 Feb. 18, 2021

(30) Foreign Application Priority Data

Aug. 16, 2019 (EP) ..... 19192106

(51) Int. Cl.

| | |
|---|---|
| ***A44C 5/24*** | (2006.01) |
| ***A44C 5/00*** | (2006.01) |
| ***A44C 5/04*** | (2006.01) |

(52) U.S. Cl.

CPC ..... *A44C 5/0053* (2013.01); *A44C 5/04* (2013.01); *A44C 5/24* (2013.01)

(58) Field of Classification Search

CPC .. F16F 3/0876; F16F 3/023; F16F 3/02; F16F 2238/024; F16F 2238/022; F16F 2236/025; F16F 2236/08; F16F 2236/085; F16F 3/04; F16F 15/1212; F16F 15/1332; F16F 1/027; F16F 1/187; A44C 5/24; A44C 5/246; A44C 5/243; A44C 5/185

USPC .... 267/69, 157, 156, 164; 16/285, 277, 297, 16/308

See application file for complete search history.

(56) References Cited

U.S. PATENT DOCUMENTS

| | | | | |
|---|---|---|---|---|
| 2,584,404 A * | 2/1952 | Webb | F23M 7/00 | 110/173 R |
| 3,880,414 A * | 4/1975 | Smith | F16F 3/04 | 267/168 |
| 3,905,403 A * | 9/1975 | Smith | B21F 35/003 | 140/71 R |

(Continued)

FOREIGN PATENT DOCUMENTS

| | | |
|---|---|---|
| EP | 1654950 A1 | 5/2006 |
| EP | 2606762 A1 | 6/2013 |

(Continued)

OTHER PUBLICATIONS

European Search Report and Written Opinion dated Jan. 30, 2020 in counterpart application No. EP19192106; w/English machine translation (total 13 pages).

*Primary Examiner* — Jack W Lavinder
(74) *Attorney, Agent, or Firm* — Seckel IP, PLLC

(57) ABSTRACT

An arrangement includes two components (3, 4; 3', 4') of a timepiece component and an axis of rotation (A1; A1'), the two components (3, 4; 3', 4') being linked to one another by an elastic articulated link (100; 100') about the axis of rotation (A1; A1'), the arrangement also includes an elastic element (10, 10'; 10") such that the relative movement of the two components (3, 4; 3', 4') takes place against the elastic element (10, 10'; 10"), wherein the elastic element (10, 10'; 10") includes at least two superposed springs (10*a*, 10*b*, 10*a'*, 10*b'*; 10*a"*, 10*b"*), each of these at least two springs (10*a*, 10*b*, 10*a'*, 10*b'*; 10*a"*, 10*b"*) taking the form of a distinct element.

21 Claims, 9 Drawing Sheets

(56) References Cited

U.S. PATENT DOCUMENTS

| | | | | |
|---|---|---|---|---|
| 3,940,038 | A | 2/1976 | Claude | |
| 4,113,298 | A * | 9/1978 | Kopp | B66C 1/48 267/158 |
| 5,099,886 | A * | 3/1992 | Squirrell | F16K 1/2261 137/856 |
| 5,465,997 | A * | 11/1995 | Heitzmann | B60G 9/003 267/257 |
| 7,124,478 | B2 | 10/2006 | Aquillon et al. | |
| 8,540,223 | B2 * | 9/2013 | Cheng | H04M 1/0237 267/159 |
| 9,049,906 | B2 | 6/2015 | Schmidt et al. | |
| 9,635,911 | B2 * | 5/2017 | Moille | A44C 5/185 |
| 2005/0071953 | A1 * | 4/2005 | Salice | E05F 5/006 16/285 |
| 2006/0090305 | A1 | 5/2006 | Aquillon et al. | |
| 2013/0160255 | A1 | 6/2013 | Schmidt et al. | |
| 2014/0101899 | A1 * | 4/2014 | Moille | A44C 5/24 24/265 WS |

FOREIGN PATENT DOCUMENTS

| | | | | |
|---|---|---|---|---|
| EP | 2721943 | A1 | 4/2014 | |
| ES | 2377515 | T3 * | 3/2012 | E05D 3/16 |
| FR | 1162735 | A | 9/1958 | |
| FR | 2251290 | A1 | 6/1975 | |

* cited by examiner

ELASTIC ARTICULATION FOR A WATCH ASSEMBLY

This application claims priority of European patent application No. EP19192106.3 filed Aug. 16, 2019, the content of which is hereby incorporated by reference herein in its entirety.

INTRODUCTION

The present invention relates to an arrangement for an elastic articulated link between two components of a watch assembly, more specifically two components of a watch exterior device, notably for a wristwatch bracelet disposed either at a clasp of this bracelet, or at links of this bracelet. It relates also to an exterior device, even more generally to a timepiece component, a clasp, a bracelet and a wristwatch as such comprising such an arrangement.

STATE OF THE ART

There are several situations in which it is necessary to implement an elastic articulation between two components of a watch exterior device, notably of a wristwatch.

The document EP1654950 describes, for example, a solution for implementing the elastic locking and unlocking of two movable blades of a bracelet clasp. A first movable blade is locked in position folded back over a second blade by the hooking of a locking hook against a locking block under the effect of one or more elastic elements.

This embodiment makes it possible to guarantee very good locking security while optimizing the force required to open the clasp, which makes it a very satisfactory solution in terms of security of closure and of manipulation.

Also, in a solution with clasp, there is generally a first setting of the positioning of the clasp relative to the bracelet, called conventional setting. However, the final length obtained is often not perfect and not optimal. For that, existing clasps, like that described by the document EP2606762, are equipped with a solution for a second setting of the length of the bracelet, complementing the first conventional setting. This second setting makes it possible to vary the initial setting, by implementing a modification of the length of the bracelet by a very simple and user-friendly manipulation, requiring neither tool nor particular skill. This second setting notably makes it possible to improve the comfort of the wearer by allowing an easy modification of the initial setting so as to overcome any changes to the circumference of the wrist, which depends for example on the temperature or ambient pressure, and on the efforts performed with the arm by the wear of the bracelet. This solution here relies on an elastic articulation between two exterior components, notably between two links of a bracelet.

Finally, these existing elastic articulation solutions are very performing but there is still a need to improve these solutions. In fact, an optimal compromise is always sought between the security and the reliability of the operation of these solutions and the perception of a user in his or her manipulation of these solutions, this perception having a direct link with the perceived impression of quality of the products incorporating such elastic articulations.

Thus, a general object of the invention is to propose an elastic articulated link solution between two components of a watch assembly, which achieves an optimal compromise between the efficiency of the elastic assembly and its perceived quality.

Notably, such a solution is more particularly sought for an application in a bracelet clasp.

BRIEF DESCRIPTION OF THE INVENTION

To this end, the invention relies on an arrangement for an elastic articulated link between two components of a watch assembly, wherein it comprises at least one elastic element comprising at least two superposed springs.

The invention is more specifically defined by the claims.

BRIEF DESCRIPTION OF THE FIGURES

These objects, features and advantages of the present invention will be explained in detail in the following description of particular embodiments given in a nonlimiting manner in relation to the attached figures in which.

Figure 1:
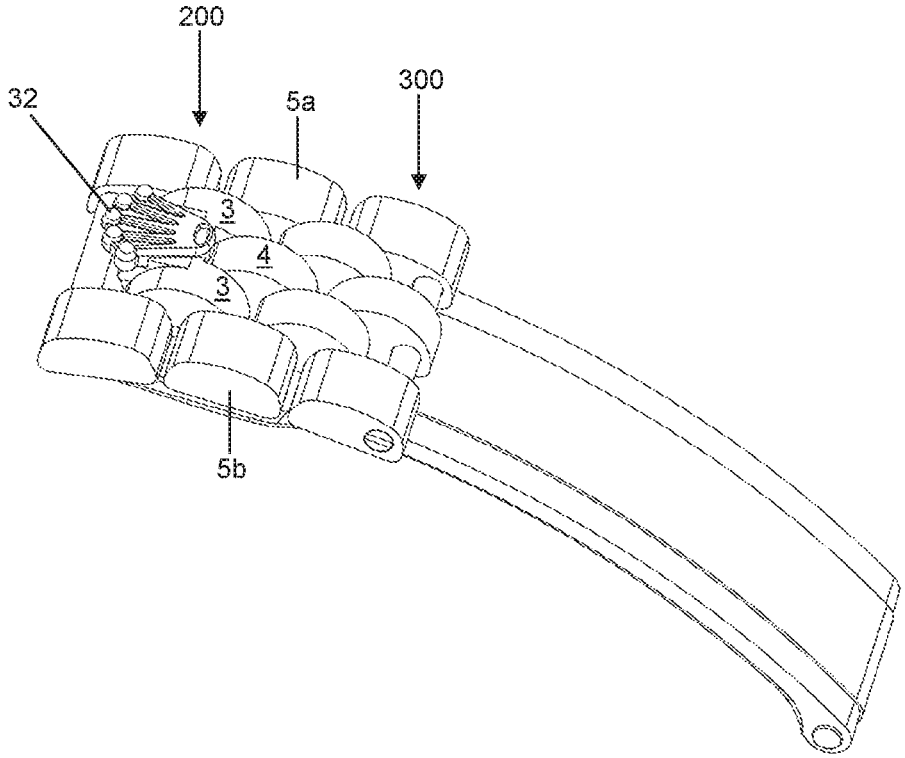
FIG. 1 represents a perspective view from above of a clasp according to a first embodiment of the invention.

The invention relies on the use of at least one elastic element comprising at least two superposed springs, as will be illustrated in detail hereinbelow, that make it possible to achieve an advantageous behavior relative to the elastic efforts implemented upon the elastic articulation between two components of a watch exterior device. Advantageously these two springs are distinct. More advantageously, one of the two springs covers all of the surface of the other of the two springs.

FIGS. 1 to 7 illustrate a clasp 200 for a bracelet according to a first embodiment of the invention, comprising two articulated blades 6*a*, 6*b*. This clasp has an operation similar to that described by the document EP1654950 and will not be described in detail. It is differentiated mainly from this solution of the state of the art by the elastic elements comprising two superposed springs, as will be detailed hereinbelow.

The clasp 200 has no cover. It is designed for the direct arrangement of the end links of two lengths of a bracelet 300 on their respective blade. The bracelet notably comprises a movable link 3, movably mounted on a first pin 1 of first axis A1, relative to a center link 4 and to two outer links 5*a*, 5*b* secured to one another notably via a third pin 9. A locking hook 31 is secured with lesser play to the movable link 3 through a second pin or rivet 2 of second axis A2. This assembly is disposed on a first movable blade 6*a* of the clasp 200.

FIGS. 1 to 6 represent a first closed configuration of the clasp 200, in which the locking hook 31 cooperates with a locking block 7 secured to a second blade 6*b* of the clasp.

The articulation of the movable link 3, notably of the hook 31, relative to the center link 4, forms an elastic articulation 100 comprising two identical or substantially identical elastic elements 10, 10'. Each elastic element 10, 10' is prestressed between, on the one hand, the locking hook 31 and, on the other hand, the center link 4 of the bracelet, secured to the outer links 5*a*, 5*b*. This center link 4 forms a fixed abutment 4*a* of the arrangement. Each elastic element thus exerts a force on the locking hook 31 which tends to bring it to and keep it in the closed configuration in which it is engaged with the locking block 7. As appears in FIG. 2 and FIGS. 3 to 6, the clasp according to the first embodiment comprises two elastic elements 10, 10' arranged substantially symmetrically on either side of a longitudinal median plane P of the clasp.

In this embodiment, the elastic articulation 100 therefore comprises two substantially identical elastic elements 10, 10'. The elastic element 10 comprises two superposed springs 10*a*, 10*b*. These two springs 10*a*, 10*b* both take the form of a curved blade. They comprise a rounded form, allowing them an arrangement about the second axis A2 within a recess 33 of the hook 31. Similarly, the two springs 10*a*', 10*b*' both substantially take the form of a curved blade. They comprise a rounded form, allowing them an arrangement about the second axis A2 within a recess 33' of the hook 31, as is more particularly visible in FIG. 6.

The two springs 10*a*, 10*b* are distinct. According to the embodiment, the two springs 10*a*, 10*b* belong to distinct elements. Each spring 10*a*, 10*b* forms a unitary and/or single-piece assembly.

The first spring 10*b* is called inner spring, because it is closer to the second axis A2. It is covered by the second spring 10*a*, called outer spring. This second, outer spring 10*a* sleeves or advantageously covers all of the surface of the first, inner spring 10*b*. It has a length greater than that of the first, inner spring 10*b*. A first end 102*a* of the second spring 10*a* allows the spring to bear on a first abutment 4*a* of the center link 4, forming a fixed abutment. A second end 101*a* of the second spring 10*a* allows bearing on an abutment 33*a* of the first recess 33 of the hook 31. This spring is thus prestressed between its two ends 101*a*, 102*a* and thus transmits a stress to the hook 31, as mentioned previously. The second, outer spring 10*a* is also bearing on the first spring 10*b*, at a contact surface, which likewise transmits an elastic effort to the second, outer spring 10*a*. The behavior of the elastic element 10 thus corresponds to the combination of the behaviors of the two springs 10*a*, 10*b*.

Figure 7:
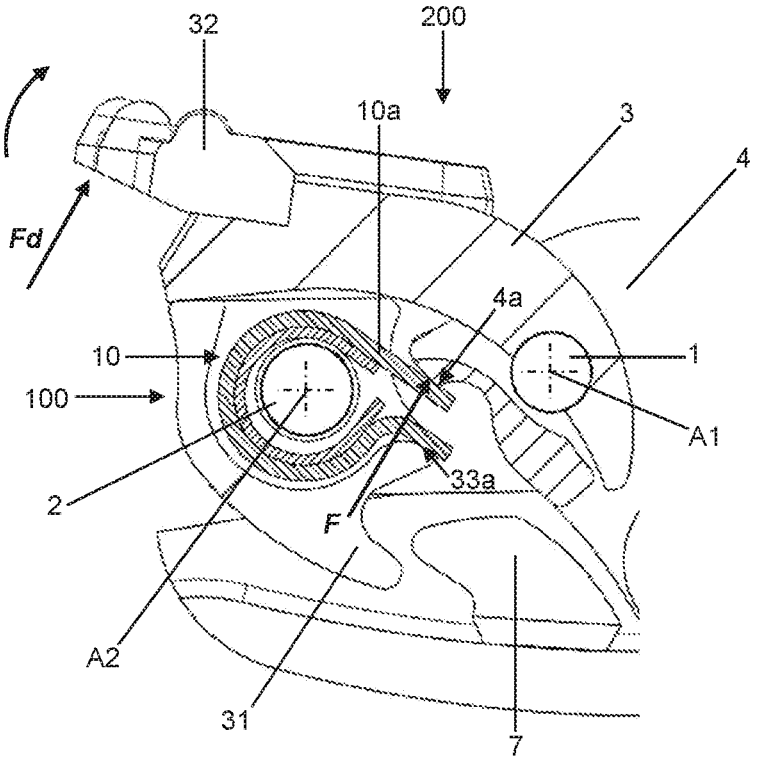
FIG. 7 represents a view similar to that of FIG. 4 upon the actuation of the elastic articulation of the clasp for its transition from the first configuration to a second configuration.

FIG. 7 illustrates the operation of the arrangement forming an elastic articulated link about said first axis of rotation A1, involving two components 3, 4 of a clasp, said two components being linked to one another by an elastic articulated link about an axis A1 of rotation, via two elastic elements 10, 10'. According to this first embodiment of the invention, the articulated link fulfills the function of locking/unlocking of the clasp. FIGS. 1 to 6 represent the clasp in a first, closed configuration, in which the locking hook 31 is engaged with a locking element 7 of the blade 6*b* of the clasp. The opening of the clasp 200 is performed through a gripping member 32 secured to the movable link 3. The actuation of the gripping member 32 requires a force Fd which induces a rotation of the movable link 3 (in the clockwise direction in FIG. 7) about the axis A1, which induces the retraction of the locking hook 31 from the locking block 7. The opening or unlocking force Fd necessary is, here, very much mostly given by the sum of the compression forces F induced by the two elastic elements 10, 10' of two springs 10*a*, 10*b*, 10*a*', 10*b*', under the effect of the displacement of the movable link 3, and therefore of the hook 31, relative to the center link 4. This force F is exerted by the springs at the abutment 4*a* on the center link 4. It is substantially oriented parallel to the direction of superpositioning of the two springs 10*b*, 10*a*, this direction being considered on the ends of the two springs in proximity to this abutment 4*a*.

Thus, on opening, the two elastic elements are compressed because of the rotation of the movable link 3 relative to the center link 4 under the effect of the gripping member 32. On closure, the elastic element is compressed because of the contact between the end of the locking hook 31 and the top of the locking block 7. That provokes the retraction of the locking hook 31 and therefore of the movable link 3, such that the locking hook 31 can be housed under the locking block 7. In all cases, the two elastic elements 10, 10' are prestressed by the abutment 4*a* of the center link 4 and the respective abutments 33*a*, 33*a*' of the recesses 33, 33'.

According to this first embodiment, the two springs 10*a*, 10*b* are not fixed to one another. Consequently, the second, outer spring 10*a* is totally free to be moved relative to the first spring 10*b* upon the compression of the springs. Such an arrangement makes it possible to best distribute the stresses in the blades forming the springs, while maximizing the stiffness of each spring, and therefore the opening or unlocking force Fd of the clasp for a given angle of rotation of the movable link 3. Moreover, such a conformation makes it possible to offer an elastic articulated link that is particularly easy to implement, by simply inserting a second spring 10*b*, 10*b*' between a first spring 10*a*, 10*a*' and an axis A2 of the pin 2, as represented schematically by FIG. 8. Obviously, it is possible as a variant to locally secure the two superposed springs, for example through a spot weld, while maintaining a relative movement of the two springs upon their compression.

Figure 2:
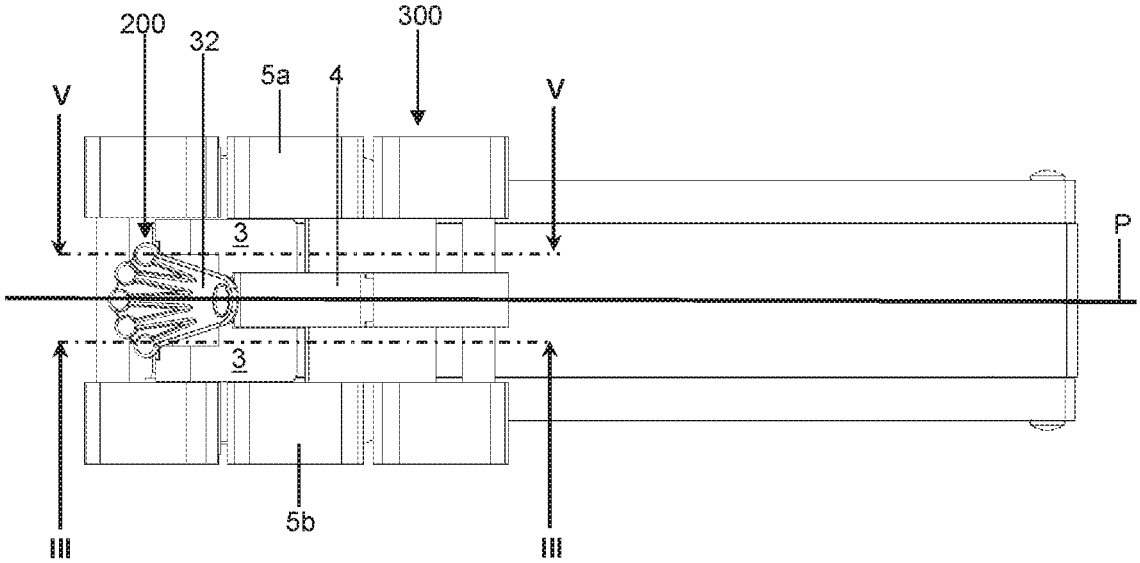
FIG. 2 represents a view from above of the clasp according to the first embodiment of the invention.
Figure 3:
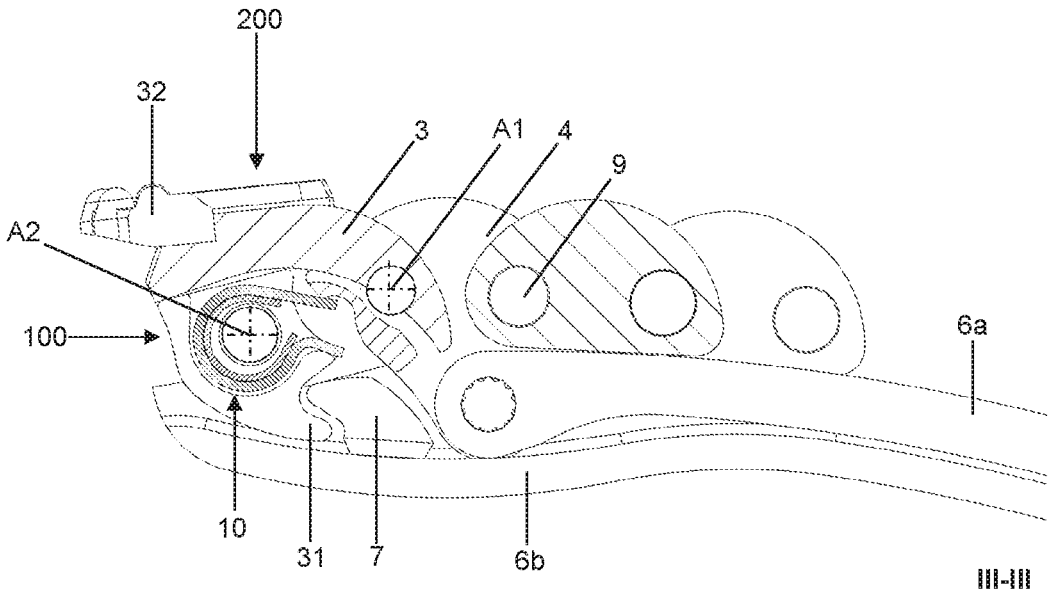
FIG. 3 represents a view in cross section III-III of the clasp in a first configuration of the clasp according to the first embodiment of the invention.
Figure 4:
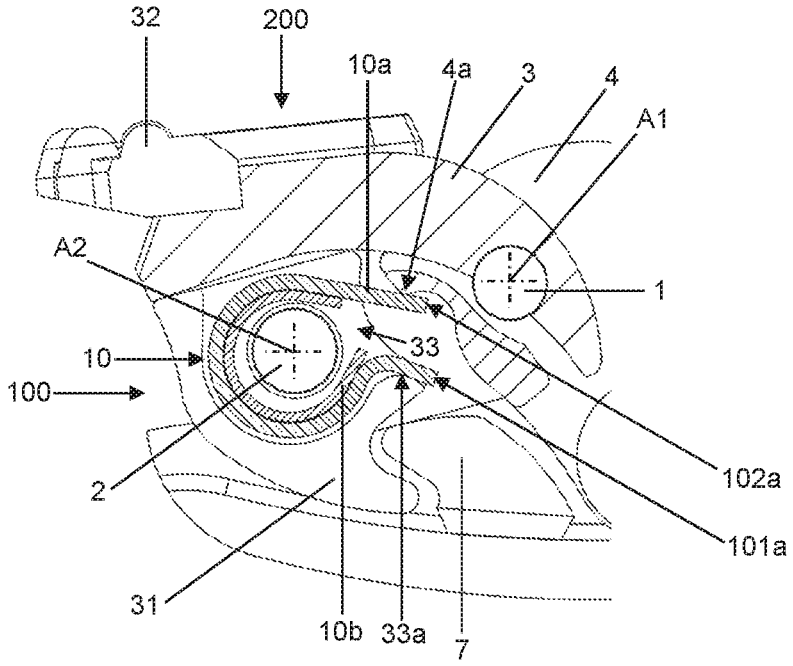
FIG. 4 represents an enlarged view of details of the cross-sectional view of FIG. 3.
Figure 5:
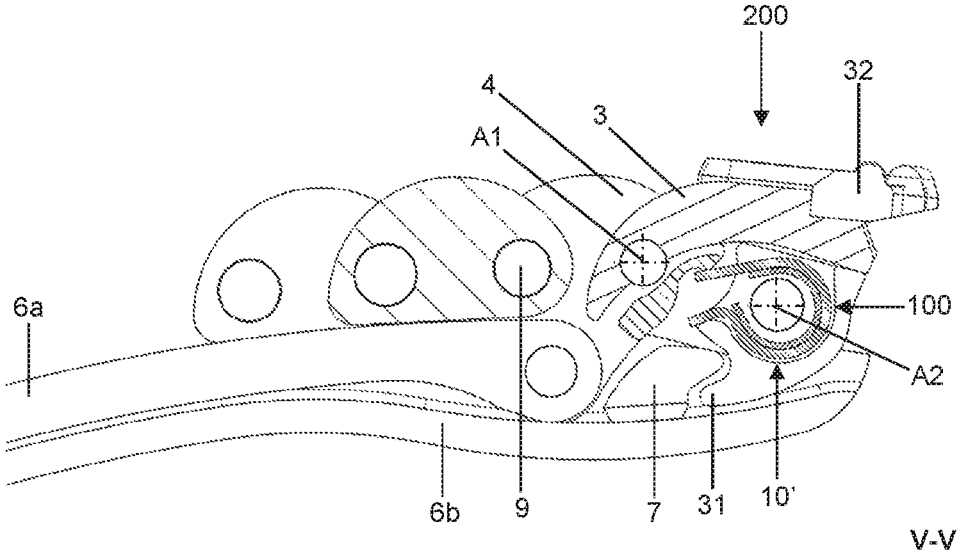
FIG. 5 represents a view in cross section v-v of the clasp in a first configuration of the clasp according to the first embodiment of the invention.
Figure 6:
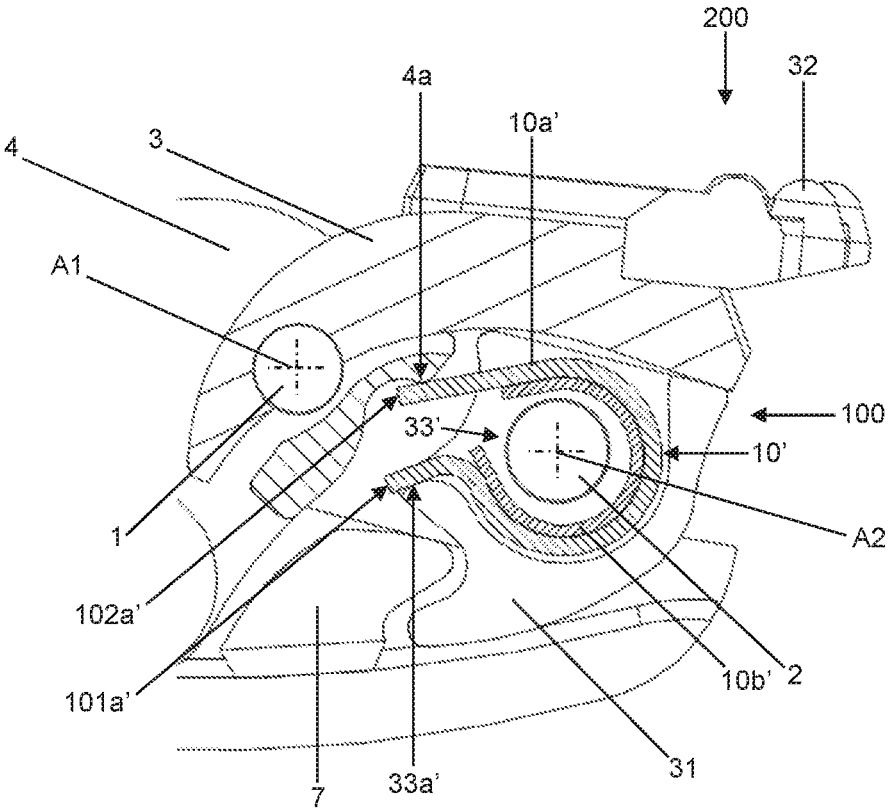
FIG. 6 represents an enlarged view of details of the cross-sectional view of FIG. 5.
Figure 9:
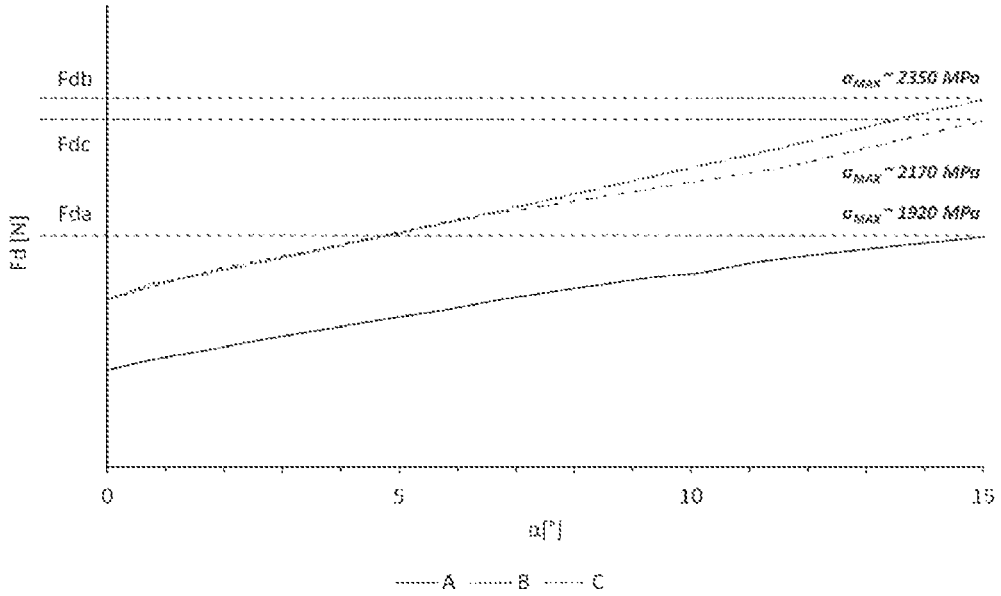
FIG. 9 illustrates a graph reporting on the forces of unlocking or opening of a clasp according to the first embodiment of the invention compared to the solutions of the state of the art.
Figure 10:
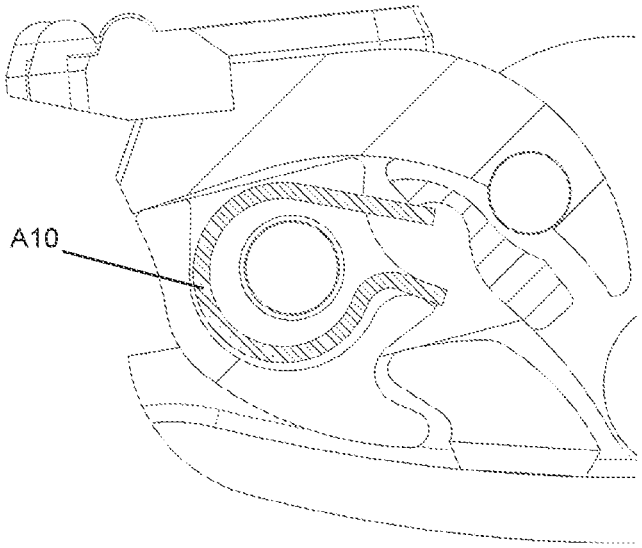
Figure 10 PRIOR ART
FIGS. 10 and 11 represent cross-sectional views of elastic articulations according to solutions of the state of the art in which the unlocking forces are illustrated by FIG. 9.
Figure 11:
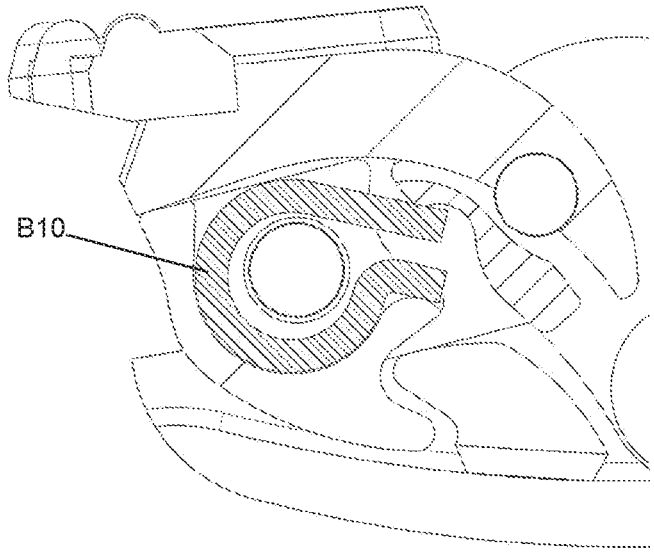
Figure 11 PRIOR ART

FIG. 9 illustrates a graph reporting on unlocking or opening forces Fda, Fdb, Fdc of a clasp as represented in FIGS. 1 and 2, for an angle of rotation of 15° of the movable link 3, for three different types of elastic articulations A, B, C. The articulation A corresponds to a first elastic articulation known from the prior art, the latter comprising two identical springs A10, A10' that are aligned and arranged substantially symmetrically on either side of a longitudinal median plane P of a clasp as represented in FIGS. 1 and 2, a spring A10 being represented on the cross section of FIG. 10. The springs A10, A10' take the form of one and the same blade that is bent back, and having a thickness of 0.18 mm. The articulation B corresponds to a second elastic articulation known from the prior art, similar to the articulation A, but comprising two springs B10, B10' each having a thickness of 0.21 mm, instead of the 0.18 mm of the articulation A. This articulation B is represented by the cross section of FIG. 11, which shows the spring B10, of greater thickness, a thickness which is exaggerated in this figure to better illustrate the difference. Finally, the articulation C corresponds to the elastic articulation according to the first embodiment of the invention, as illustrated by FIGS. 4 and 5, lying on two pairs of superposed springs, the outer springs 10*a*, 10*a'* being two curved blades having a thickness of 0.18 mm and the inner springs 10*b*, 10*b'* being two curved blades having a thickness of 0.14 mm. The springs or the blades are, here, manufactured in the same material, in steel, in particular Nivaflex.

These three measures make it possible to illustrate the advantage of the invention. In fact, it is noted that, for one and the same opening angle $\alpha$, for example 15°, the force Fdc produced by the articulation C of the invention, is increased by the order of 50% compared to the force Fda produced by the articulation A, while inducing stresses less than the elastic limit of the material constituting the blades of the spring. The force Fdb produced by the articulation B is, for its part, substantially equal to the force Fdc. However, the stresses (according to the Von Mises criterion) are not acceptable given the elastic limit of the constituent material of the spring, which is of the order of 2500 MPa for the Nivaflex material. According to the teachings of the state of the art, increasing the opening or unlocking force of such an unlocking device essentially involves a thickening of all or part of the springs involved in the elastic articulation, which can lead to a risk of plasticizing of said blades beyond a given thickness, as is the case for the articulation B. In other words, the maximum opening force of the unlocking device of the clasp is dependent on the maximum stresses that each of said blades forming a spring is likely to withstand, which can be limiting with respect to the expected opening force.

Figure 8:
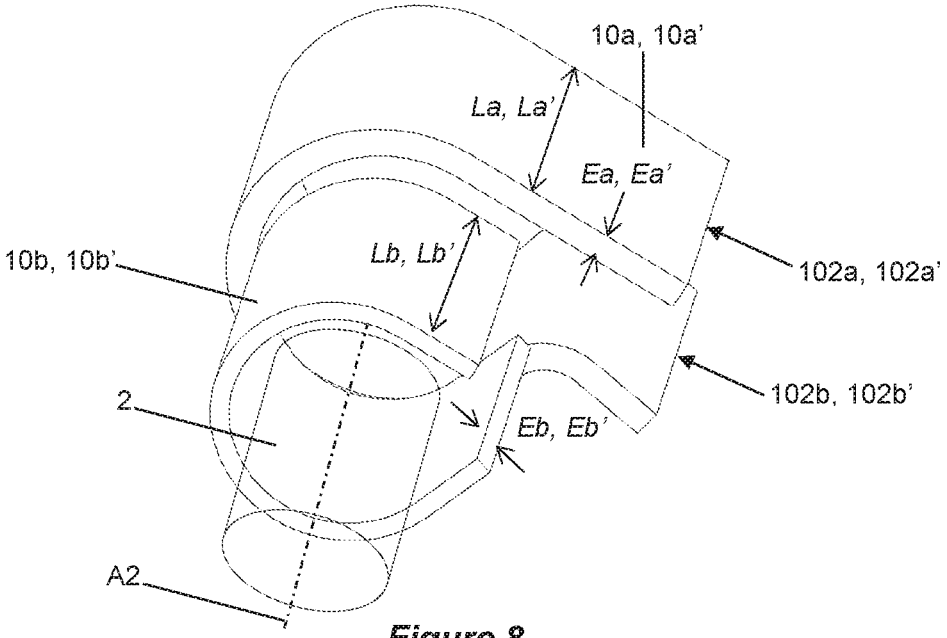
FIG. 8 represents an exploded perspective view of an elastic element of the elastic articulation according to the first embodiment of the invention.

The articulation C according to the invention comprises elastic elements each comprising two superposed springs, these two springs having a different thickness. Obviously, these springs can, as a variant, have identical thicknesses. They can also have the same width La, La', Lb, Lb' as illustrated by FIG. 8, or not. The materials of the superposed springs 10*a*, 10*b* can also be identical or not.

The curves of FIG. 9 are proposed by way of example, to illustrate the effect of the invention. As a variant, the at least two springs of the elastic element according to the invention have any other thickness Ea, Eb, Ea', Eb' advantageously lying between 0.1 mm and 0.25 mm, even between 0.12 mm and 0.2 mm, even between 0.13 mm and 0.19 mm. Preferentially, the at least two springs of the elastic element are manufactured in steel, notably in Nivaflex.

It emerges that the elastic articulation according to the invention has the following advantages:

- it generates a repeatable opening or unlocking force, and does so independently of the elasticity of the unfolding branches and/or of the cover of the clasp;
- it makes it possible to maximize the return torque and thus improve the sensations in the manipulation thereof;
- despite this increased return torque relative to the state of the art, satisfactory stress levels are retained within the constituent material of the springs;
- it is easily incorporated in all the clasp versions provided with a locking device implementing an elastic articulation.

Naturally, the elastic element according to the invention can take forms other than that represented. First of all, this elastic element can comprise more than two superposed springs. It can comprise, for example, three, four, or more superposed springs. Thus, the invention relies on the use of an elastic element with multiple superposed springs. Moreover, the articulation according to the invention can comprise a single elastic element.

Moreover, the invention can quite naturally be implemented in a clasp provided with a cover. The movable link 3 can thus take the form of a gripping member provided with a locking hook, and the center link 4 can take the form of a cover on which said gripping member provided with said locking hook is pivoted about an axis 1. In such a clasp, the axis A1 can advantageously coincide with the axis A2.

Figure 12:
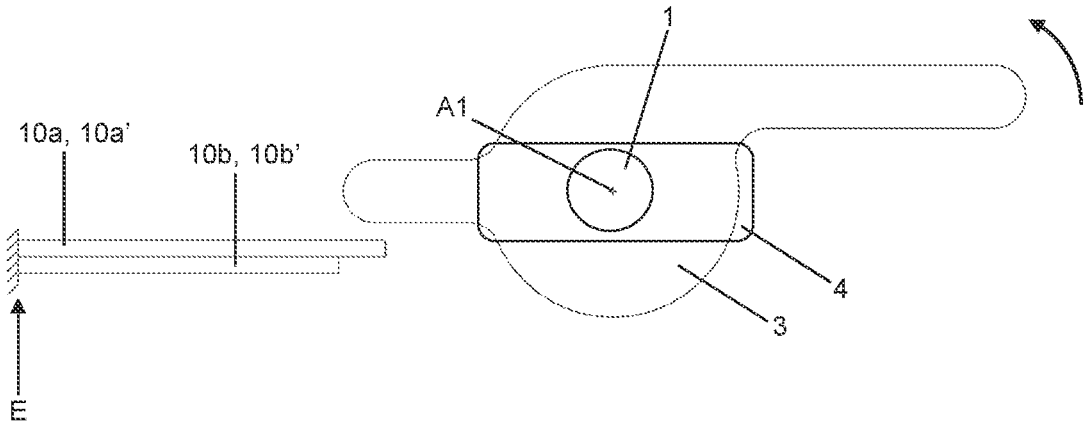
FIG. 12 schematically represents an elastic element according to a variant embodiment of the invention.

Furthermore, according to an alternative variant embodiment, each spring can take any other form. For example, as illustrated by FIG. 12, two superposed springs 10*a*, 10*b* can take the form of blades or of beams, that is to say of flat and thin elements, designed to be deformed by bending upon the rotation of a first component 3, 3* relative to a second component 4, 4*. In this context, the blades can, for example, be made locally secure at their fitting zone E adjoining the components 3 and 4. Moreover, they can have a section that is constant or not.

Naturally, an elastic element according to the concept of the invention can be used in any elastic articulation between two watch components of an exterior device. Thus, FIGS. 13 to 15 illustrate, by way of example, the implementation of the concept of the invention in a precision extension device 200' for extending the length of a bracelet, as described in the document EP2606762, incorporated for reference, which will not be fully described.

Figure 13:
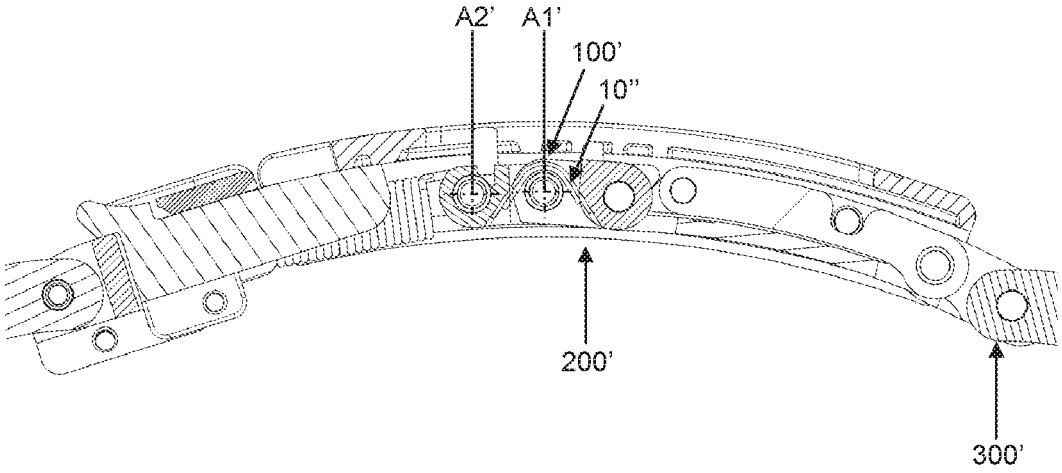
FIG. 13 represents a cross-sectional view of a clasp in a first configuration according to a second embodiment of the invention.
Figure 14:
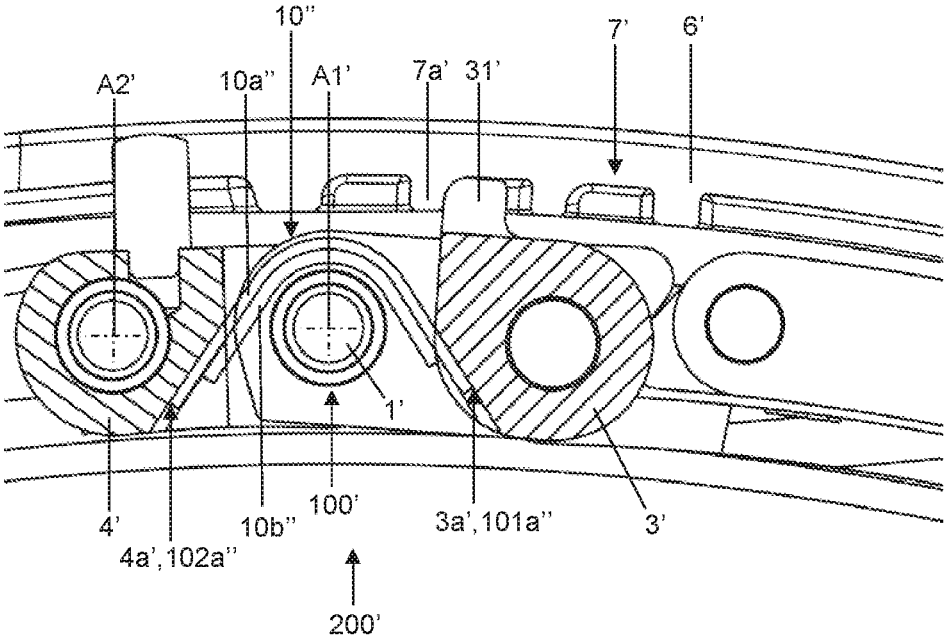
FIG. 14 represents a view of details of the cross-sectional view of FIG. 13, illustrating the elastic articulation of the clasp according to the second embodiment of the invention.
Figure 15:
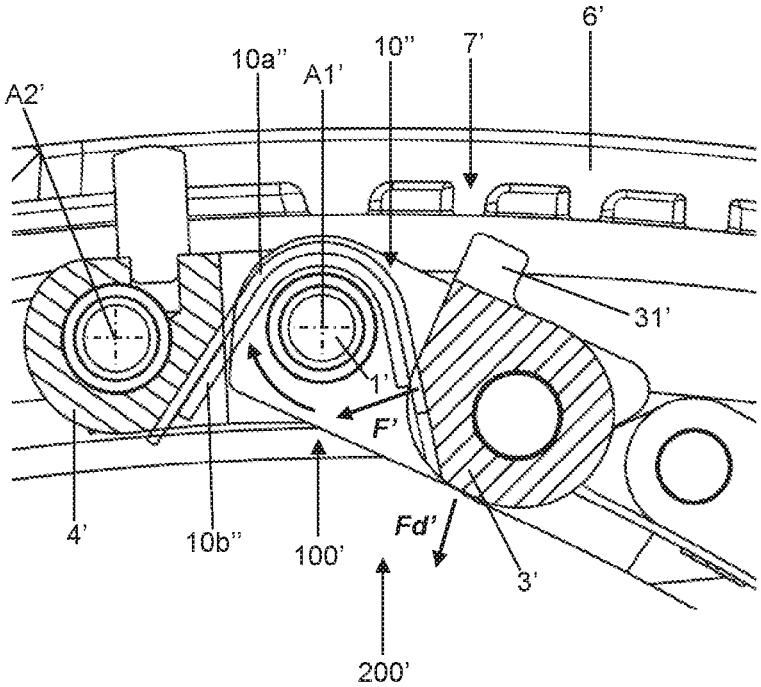
FIG. 15 represents a cross-sectional view similar to FIG. 14, illustrating the elastic articulation of the clasp according to the second embodiment of the invention in a second configuration.

FIGS. 13 to 15 thus more specifically illustrate the detail of an elastic articulation 100' implemented in the extension device 200', according to a second embodiment of the invention. In this embodiment, the articulation comprises a single elastic element 10" comprising a set of two superposed springs 10*a*", 10*b*". These two superposed springs are arranged around a pin 1' (or axis of rotation) of axis A1', forming an axis of rotation of a movable link 3' of a bracelet 300'. Each spring is V-shaped, obtained by a curved blade, whose base is rounded to follow a part of the rounded surface of the pin 1'.

The moveable link 3' can be actuated in rotation about the axis A1' relative to a link 4' that is translationally movable in the longitudinal direction of a clasp cover 6' through a guiding axis A2'. The cooperation of a finger 31' of the movable link 3' with a tooth 7*a'* of teeth 7' of the cover 6', under the effect of the elastic articulation 100', makes it possible to configure the bracelet 300' according to a predefined length. To do this, the first and second ends 101*a*", 102*a*" of the second, outer spring 10*a*" are prestressed respectively against a first abutment 3*a'* of the movable link 3' and a second abutment 4*a'* of the translationally movable link 4', so as to press the finger 31' against the teeth 7'.

A rotation of the link 3' in the clockwise direction, as represented in FIG. 15, against the elastic element 10", induces the retraction of the finger 31' from the teeth 7' and thus allows the translation of the translationally movable link 8', and therefore of the movable link 3' relative to the cover 6' of the clasp. In this configuration, the length of the bracelet 300' can thus be adjusted.

The gains obtained by the elastic element 10" are the same as those of the elastic elements of the first embodiment, namely notably an opening force of the extension device 200' which is maximized within a given bulk, and while retaining satisfactory stress levels within the constituent material of the blades of the spring.

Naturally, some elements of the solutions described previously can, as a variant, be in another form. Notably, as has been seen, one or more elastic elements with multiple superposed springs can be used in one and the same elastic articulation.

This superpositioning of springs means that the springs have a surface of contact, direct or indirect, which allows them to act on one another upon the actuation of the elastic articulation, such that their mutual effects are combined to optimize the induced elastic forces while minimizing the stresses within them. Thus, the two springs are advantageously superposed in a direction parallel to the elastic force that they exert upon the actuation of the elastic articulation.

Furthermore, as has been seen in the context of the extension device 200', the elastic element can advantageously be disposed about an axis of rotation of two components of a watch exterior device involved in the elastic articulation. Obviously, as has been described in the context of the clasp 200, the elastic element could be disposed offset and/or dissociated from this axis of rotation. It could be arranged about any other axis, or independently of an axis.

The at least two springs of the elastic element advantageously take the form of two blades. Furthermore, advantageously, a first blade covers all of a second blade. Alternatively, the superpositioning of the blades can be only partial.

Furthermore, the at least two springs of the elastic element advantageously have a thickness of between 0.1 mm and 0.25 mm, even between 0.12 mm and 0.2 mm, even between 0.13 mm and 0.19 mm. Preferentially, these at least two springs are manufactured in steel, in particular Nivaflex.

Figure 16:
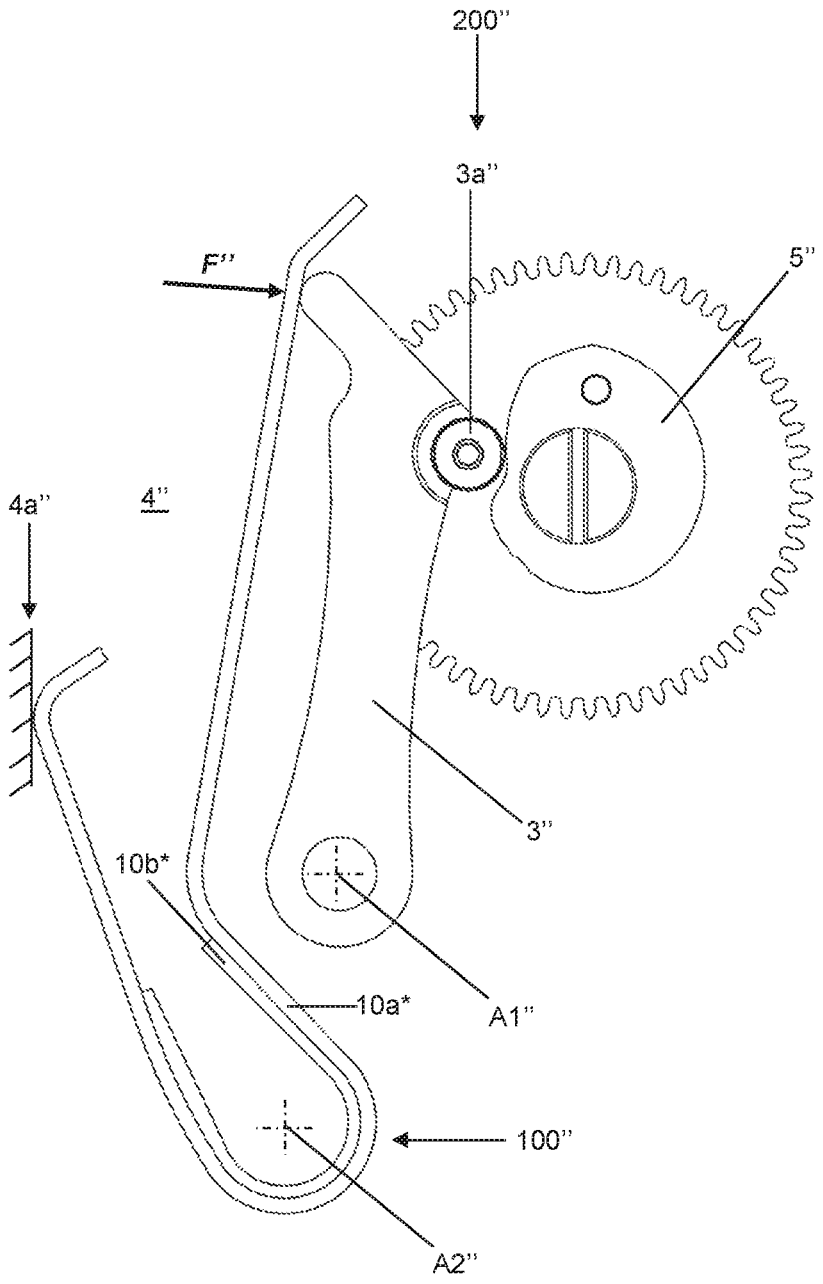
FIG. 16 represents a view of a calendar cam lever device according to a variant embodiment of the invention.

The invention has been illustrated on the basis of a bracelet clasp associated with a wristwatch, which is, moreover, also affected as such by this invention, and more specifically at the locking mechanism of this clasp, or at a bracelet extension device. As a variant, this principle can be implemented for any articulated elastic link between two watch components, whether this movement is a pure rotation or more complex, such as a rotation combined with another displacement. This principle can, moreover, be implemented for the application of an elastic articulation 100" in the movement. As an example, such an elastic articulation 100" can be exploited for the definition of a calendar cam lever device 200" as illustrated in FIG. 16. As an example, this device 200" can comprise a lever 3" pivoted on a first axis A1" relative to a movement blank 4". The end 3*a*" of the lever 3" is returned elastically against a calendar cam 5" by an elastic element 10* having the particular feature of comprising two U-shaped springs 10*a****, 10*b** arranged about a second axis A2" within a recess (not represented in FIG. 16) of the blank 4", and prestressed between the lever 3" and an abutment 4*a*" of the blank 4". The expected gains are the same as those described previously, namely a return force F" of the elastic element 10* that is maximized while retaining acceptable stress levels within the blades of the springs 10*a**, 10*b****.

The invention claimed is:

1. An arrangement comprising:

two components of a timepiece component, and an axis of rotation, an elastic articulated link linking the two components to one another about the axis of rotation, and an elastic element arranged so that the relative movement of the two components takes place against the elastic element, wherein the elastic element comprises at least two superposed springs, each of the at least two superposed springs have a form of a distinct element, wherein at least one of the at least two superposed springs is not fixed to any other of the at least two superposed springs, so as to be freely movable relative to any other of the at least two superposed springs.

2. The arrangement as claimed in claim 1, wherein the at least two superposed springs of the elastic element are superposed in a direction substantially parallel to a force acting against the at least two superposed springs upon a relative rotational movement of the two components.

3. The arrangement as claimed in claim 1, wherein the elastic element is arranged around an axis.

4. The arrangement as claimed in claim 3, wherein the elastic element is arranged around the axis of rotation of the first and second components.

5. The arrangement as claimed in claim 1, wherein the at least two superposed springs of the elastic element have a form of a curved blade.

6. The arrangement as claimed in claim 1, wherein the at least two superposed springs of the elastic element have a form of at least one first blade and at least one second blade, the at least one first blade covering at least partially the second blade.

7. The arrangement as claimed in claim 6, wherein the at least one first blade covers all of the second blade.

8. The arrangement as claimed in claim 1, wherein the at least two superposed springs of the elastic element have a thickness of from 0.1 mm to 0.25 mm.

9. The arrangement as claimed in claim 1, wherein the at least two superposed springs includes at least two springs having different thicknesses.

10. A watch exterior device comprising an arrangement for the elastic articulated link between two components as claimed in claim 1.

11. The watch exterior device as claimed in claim 10, wherein the watch exterior device is a bracelet extension device, the first component is a first, rotationally movable link, and the second component is a second, translationally movable link relative to a clasp cover.

12. The watch exterior device as claimed in claim 11, wherein the watch exterior device is a clasp, the first component is a first, rotationally movable link comprising a finger, the second component is a translationally movable link, so that the clasp is adapted to occupy a closed position in which the first, rotationally movable link can be fixed onto the clasp, the finger cooperating with a tooth of complementary teeth arranged on the clasp, and the elastic element tends to press the rotationally movable link toward the complementary teeth arranged on the clasp.

13. A wristwatch comprising a watch exterior device as claimed in claim 10.

14. The arrangement as claimed in claim 13, wherein the at least two superposed springs of the elastic element are secured on the at least a part of their surfaces by a weld, a glue, or a mechanical means.

15. The watch exterior device as claimed in claim 1, wherein the watch exterior device is a clasp for a bracelet wristwatch, the first component is a first movable bracelet link comprising a gripping member and a locking hook, the second component is a second bracelet link, the clasp comprises at least one first movable clasp blade and at least one second movable clasp blade, the first and second movable clasp blades being movable relative to one another, the first movable link and the locking hook being disposed at a free end of the first movable clasp blade, so as to be adapted to cooperate with a locking block of the second clasp blade on which the first movable clasp blade is articulated at a second end opposite the free end, and the first and second components are mounted on one of the same movable clasp blade selected from the group consisting of the first and second movable clasp blades.

16. The watch exterior device as claimed in claim 15, wherein the first movable link has a form of a gripping member provided with a locking hook, wherein the second link has a clasp cover form, on which the first movable link is pivoted.

17. The watch exterior device as claimed in claim 15, wherein the elastic element exerts a torque on the locking hook to bring the locking hook to a position corresponding to an engagement of the locking hook with the locking block of the second clasp blade, the elastic element being under tension in the position, so that the locking hook must pivot against the elastic element upon engagement and disengagement of the locking hook with the locking block.

18. A wristwatch comprising an arrangement for the elastic articulated link between two components of a timepiece component as claimed in claim 1.

19. The arrangement as claimed in claim 1, wherein the at least two superposed springs of the elastic element are secured on at least a part of their surfaces.

20. The arrangement as claimed in claim 1, wherein a first one of the at least two superposed springs has several curves in opposed directions, and a second one of the at least two superposed springs has a single curve in a single direction.

21. The arrangement as claimed in claim 1, wherein a length of a first one of the at least two superposed springs is greater than a length of a second one of the at least two superposed springs.

* * * * *